US005629751A

United States Patent [19]

Tsumura et al.

[11] Patent Number: 5,629,751

[45] Date of Patent: May 13, 1997

[54] AUTOMATIC PHOTOGRAPHIC DEVELOPING MACHINE

[75] Inventors: Kazunori Tsumura; Junichi Miyai, both of Wakayama, Japan

[73] Assignee: Noritsu Koki Co., Ltd., Wakayama, Japan

[21] Appl. No.: 675,187

[22] Filed: Jul. 3, 1996

[30] Foreign Application Priority Data

Jul. 10, 1995 [JP] Japan ..... 7-173471

[51] Int. Cl.[6] ..... G03D 3/08

[52] U.S. Cl. ..... 396/622; 396/646

[58] Field of Search ..... 354/316, 320, 354/321, 322, 338, 339

[56] References Cited

U.S. PATENT DOCUMENTS 4,423,947 1/1984 Jelinek et al. ..... 354/320

5,063,401 11/1991 Oberkersch et al. ..... 354/320

5,432,581 7/1995 Patton et al. ..... 354/321

*Primary Examiner*—A. A. Mathews

*Attorney, Agent, or Firm*—Wenderoth, Lind & Ponack

[57] ABSTRACT

An automatic photographic developing machine has easily detachable top turn guides each provided with a locking mechanism that allows any incompletely set top turn guide to be pushed to an accurate set position and locked. The top turn guides are detachably mounted between handles provided at tops of racks hung in treating tanks. Each top turn guide has a support piece to be supported on top surfaces of the handles, and a pair of front and rear control pieces. Each control piece has a protrusion. The handles are formed with recesses. Each top turn guide is inserted between a pair of adjacent handles with the control pieces deformed inwardly by gripping them from opposite sides. The control pieces are released with the support piece supported on the top surfaces of the handles to let the protrusions engage in the recesses. The top turn guide is thus locked in position. Even if a top turn guide is incompletely set, it is pressed down by a pusher provided on a top cover to its predetermined set position with high accuracy by closing the top cover.

4 Claims, 8 Drawing Sheets

AUTOMATIC PHOTOGRAPHIC DEVELOPING MACHINE

BACKGROUND OF THE INVENTION

This invention relates to an automatic photographic developing machine for developing photosensitive material such as photographic paper or film by passing it through different kinds of treating solutions in treating tanks.

As shown in FIG. 8, a typical conventional automatic developing machine has a plurality of treating tanks 61 arranged in a developing box 60 in a row. A photosensitive material A is fed through the treating solutions in the tanks 61 from the tank at one end of the row toward the tank at the other end of the row. A rack 62 is inserted in each treating tank 61 to guide photosensitive material A. An inlet guide 63 is provided at the inlet of the treating tank 61 provided near the inlet end of the developing box 60 to guide the photosensitive material A inserted into the developing box 60 into the first rack 62.

Also, top turn guides 64 are provided above and between the adjacent racks 62 to guide the photosensitive material A coming out of each rack 62 into the next rack 62.

Each rack 62 has a feed mechanism 65 for feeding photosensitive material A. If the material A is a film, the feed mechanism 65 comprises a plurality of sprockets adapted to engage square holes formed in a leader to which the leading end of the film is connected. If the photosensitive material is a sheet of photographic paper, the feed mechanism comprises a pair of feed rollers for sandwiching the photographic paper. The feed rollers or the sprockets are rotated in one direction by an external driving means.

Such an automatic developing machine is soiled gradually with use. Thus, it has to be cleaned periodically or whenever necessary. To facilitate cleaning and in order that any photosensitive material A that may get stuck in the developing machine easily can be removed therefrom, the racks 62, the inlet guide 63 and the top turn guides 64 are detachably mounted so as to be lifted upward by opening a top cover 66 of the developing box 60.

More specifically, as shown in FIGS. 8 and 9, the racks 62 are simply hung in the treating tanks 61, while the inlet guide 63 and the top turn guides 64 have upper support pieces 68 and 69 supported on the top surfaces of handles 67 provided at the tops of the racks 62. By turning knobs 70 rotatably mounted on the handles 67, the inlet guide 63 and the top turn guides 64 are pressed down.

One shortcoming of this conventional automatic developing machine is that it is troublesome to mount or dismount the inlet guide 63 and the top turn guides 64 because, for this purpose, all the knobs 70 have to be turned. Another problem is that an operator tends to frequently forget to lock a knob 70 or two. Also, if the inlet guide 63 or any top turn guide 64 is set incompletely, it is impossible to turn the corresponding knob 70. Thus, any incompletely set inlet guide or top turn guide has to be removed and set again, which is extremely troublesome.

An object of this invention is to provide an automatic photographic developing machine having a locking means that locks the inlet guide and the top turn guides simultaneously when they are set in position, and a means that can move any of the inlet guide and top turn guides that is set incompletely to a completely set position by closing the top cover.

SUMMARY OF THE INVENTION

According to this invention, there is provided an automatic photographic developing machine comprising a developing box, a plurality of treating tanks housed in the developing box, and racks mounted in respective treating tanks and each having a handle for guiding a photosensitive material fed through the treating tanks. An the inlet guide is detachably mounted between a front wall of one of the treating tanks that is located at an inlet of the developing box and a handle of one of the treating tanks to guide a photosensitive material fed into the developing box into the rack in such one treating tanks. The inlet guide has a support member supported on the top surface of the handle of the rack and a fixed control piece and a resiliently deformable movable control piece provided opposite to the handle of the rack, the movable control piece being formed with a protrusion adapted to engage in a recess formed in the front surface of the handle.

According to a further feature of the invention, there is provide an automatic photographic developing machine comprising a developing box, a plurality of treating tanks housed in the developing box, and racks mounted in respective treating tanks for guiding a photosensitive material fed through the treating tanks, the each rack having a handle at a top, thereof. Top turn guides are mounted between the handles for guiding a photosensitive material fed upwardly out of each of the racks into a next rack. Each of the top turn guides has a support member supported on a top surface of a handle with the top turn guide set accurately in position, and a pair of resiliently deformable control pieces that oppose respective handles, each of the control pieces being formed with a protrusion adapted to engage in a recess formed in a front or back surface of each handle.

Other features and objects of the present invention will become apparent from the following description made with reference to the accompanying drawings, in which:

DETAILED DESCRIPTION OF THE PREFERRED EMBODIMENT

The embodiment of this invention is described with reference to FIGS. 1–7.

Figure 1:
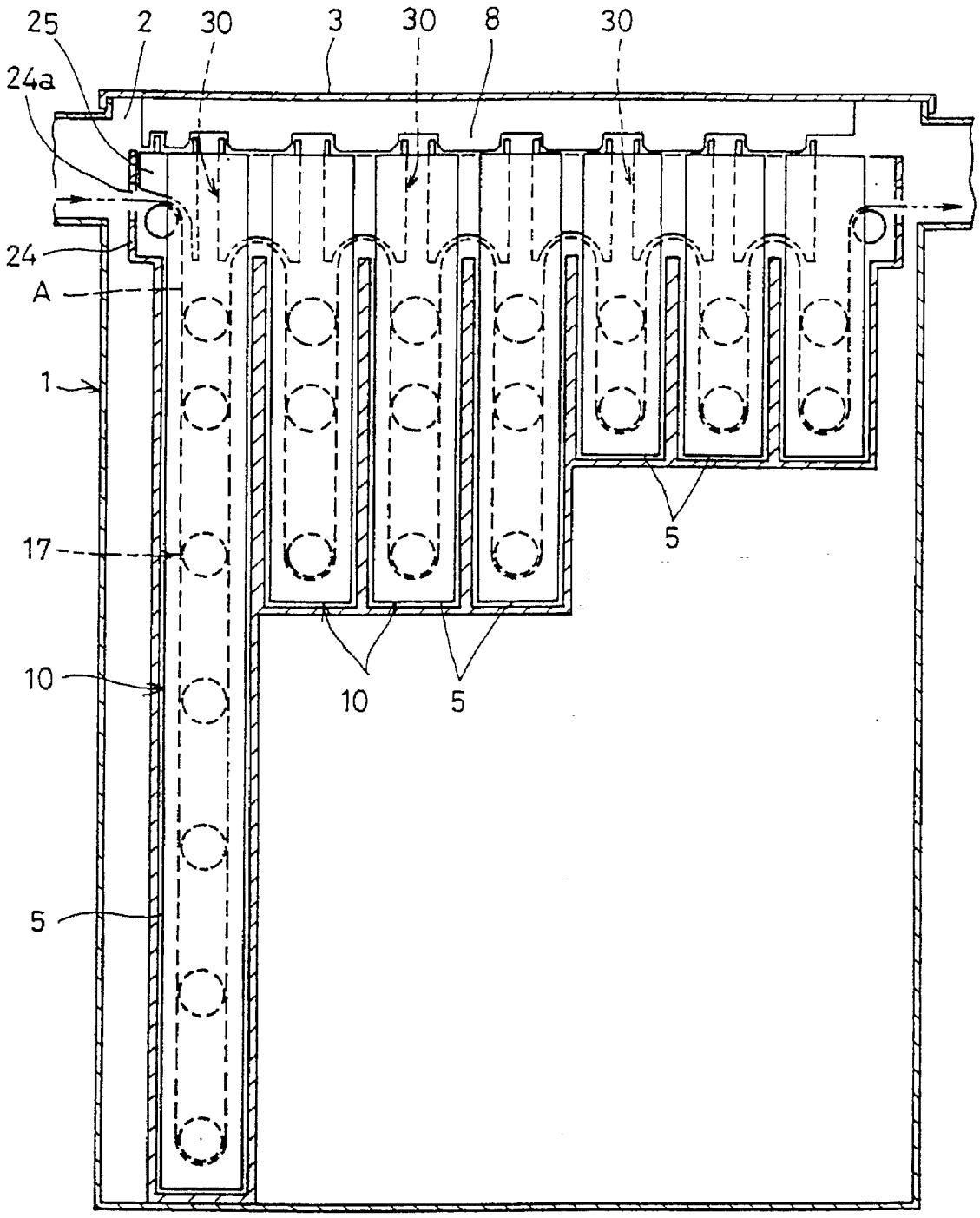
FIG. 1 is a schematic view of the automatic photographic developing machine according to this invention.
Figure 2:
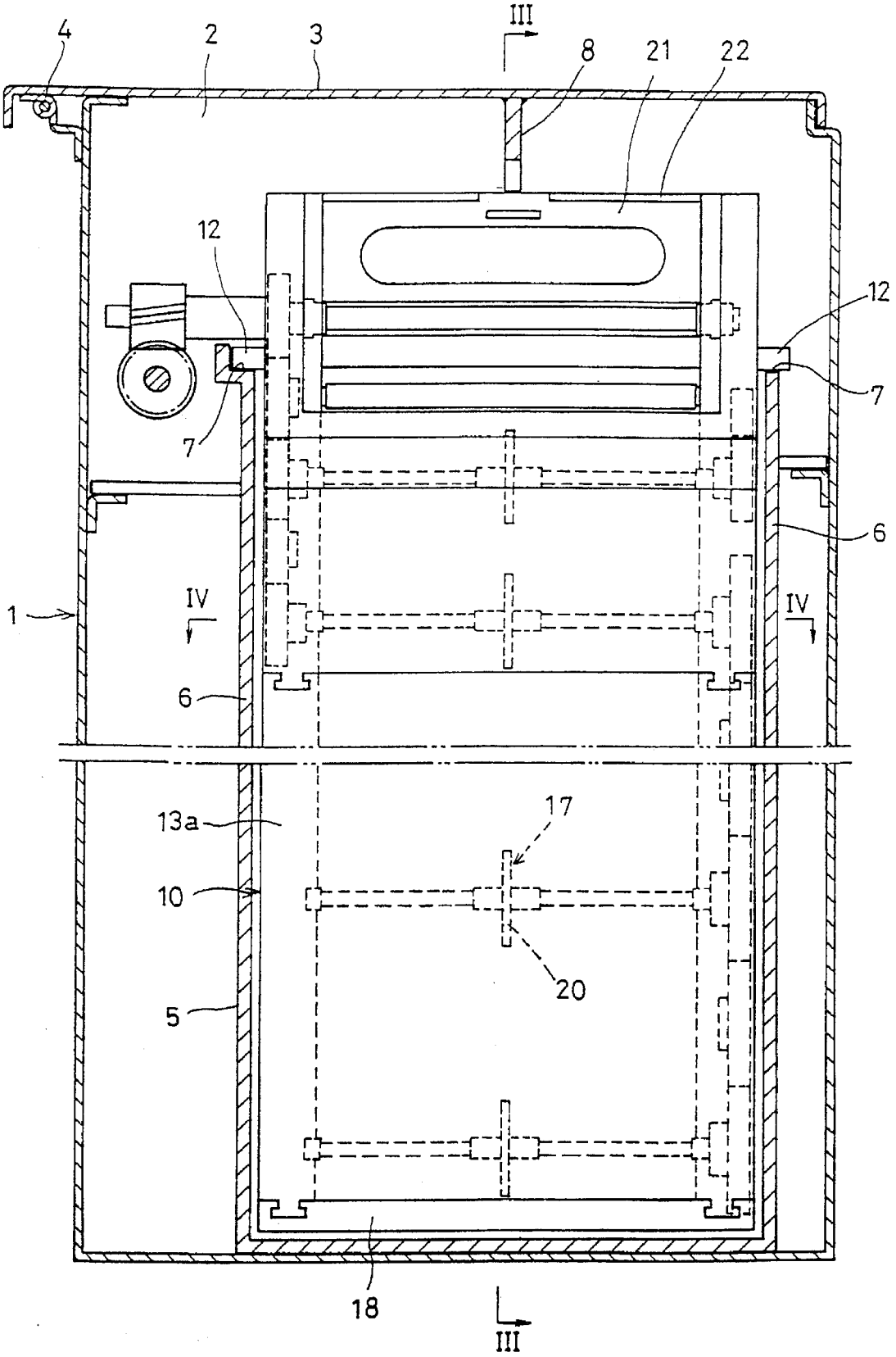
FIG. 2 is a vertical sectional side view of a racks mounted therein.

First referring to FIGS. 1 and 2, a developing box 1 has a top opening 2 and a top cover 3 pivotable about a hinge 4 to cover the opening 2. The developing box 1 houses a plurality of treating tanks 5 arranged in a row in the direction in which photosensitive material A is fed. A rack 10 is set in each treating tank 5 to guide photosensitive material A fed through the tanks.

Referring to FIGS. 2 to 5, the racks 10 have a rectangular section. A plurality of hanger pins 12 extend through side plates 11 of each rack 10 at outer upper portions thereof. Pins 12 are supported on support portions 7 provided on side plates 6 of each treating tank 5 so that the racks 10 can be pulled up out of the treating tanks 5.

A center guide 14 is provided between rack plates 13*a* and 13*b* located in front and rear of each rack 10. A downward feed path 15 for photosensitive material A is defined between the center guide 14 and the rear rack plate 13*b*, while an upward feed path 16 is defined between the center guide 14 and the front rack plate 13*a*.

Photosensitive material A is inserted into the downward feed path 15 from its top and fed downward in the path 15 by a feed mechanism 17 in the rack 10.

At the bottom of the rack 10, the photosensitive material is turned 180° by a bottom turn guide 18, and then is fed upward in the upward feed path 16 by the feed mechanism 17. A pair of outlet rollers 19 are provided at the top of the upward feed path 16. By rotating the outlet rollers 19, the photosensitive material A is fed up out of the rack 10.

The type of the feed mechanism 17 is determined according to the type of photosensitive material A. For example, if it is a film, the feed mechanism 17 comprises a plurality of sprockets 20 adapted to engage square holes formed in a leader connected to the leading end of the film. The adjacent sprockets 20 are spaced a distance smaller than the length of the leader and rotated by an external driving means.

If the photosensitive material is a sheet of photographic paper, the feed mechanism 17 may comprise a plurality of pairs of feed rollers arranged along the downward and upward feed paths and rotated by an external driving source.

Figure 5:
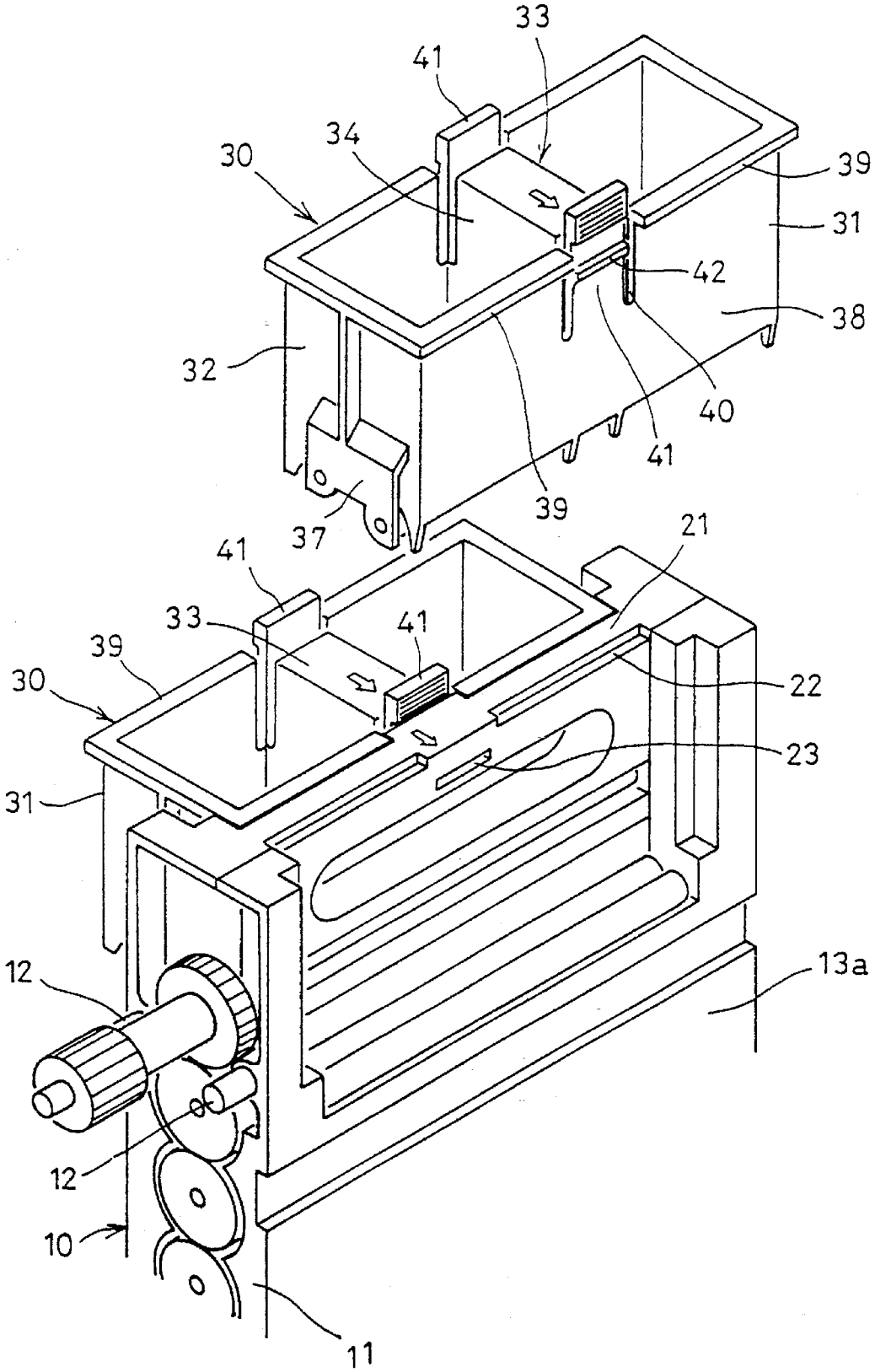
FIG. 5 is an exploded perspective view of a rack and a top turn guide.
Figure 7:
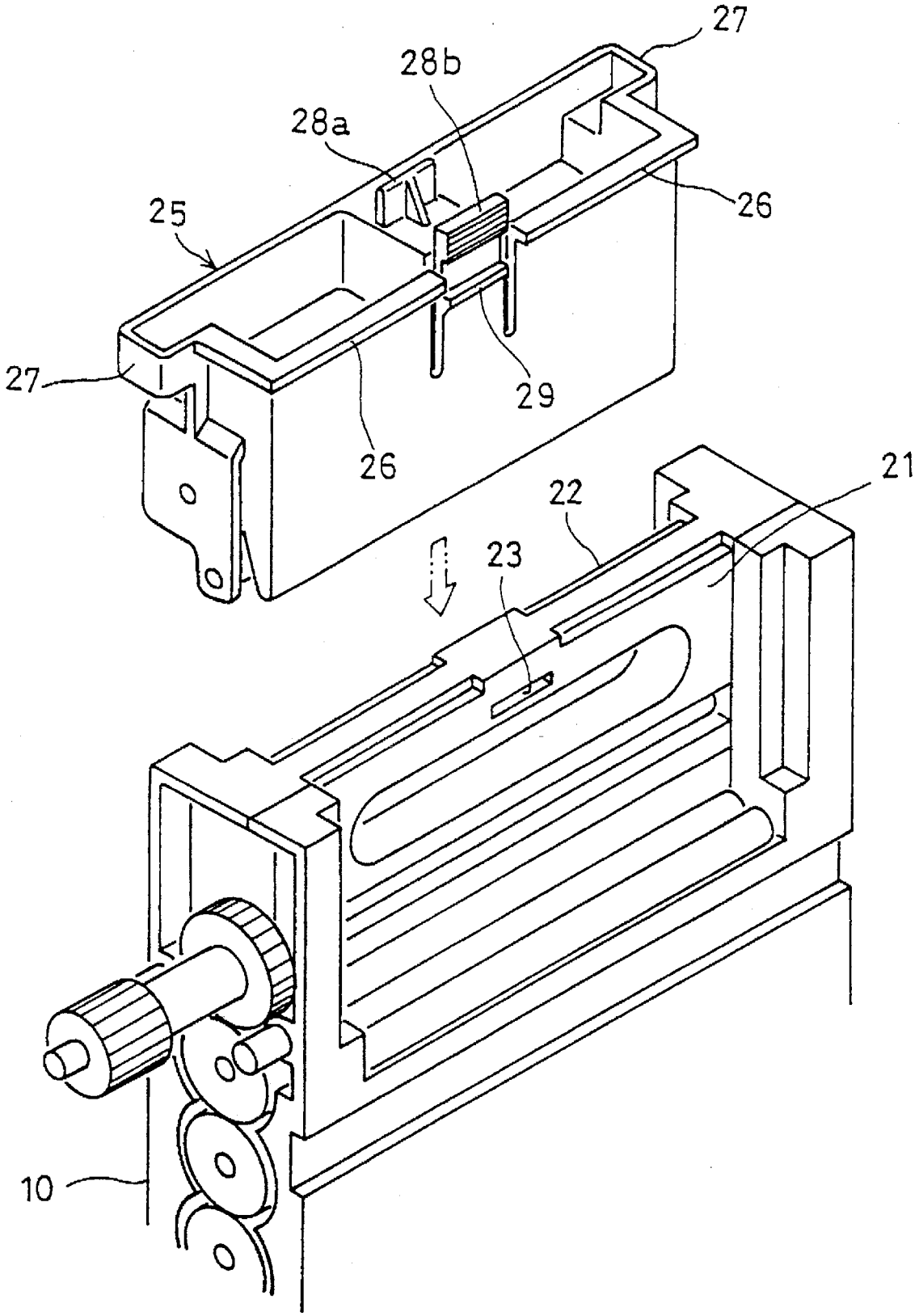
FIG. 7 is an exploded perspective view of the inlet guide and the rack.
Figure 8:
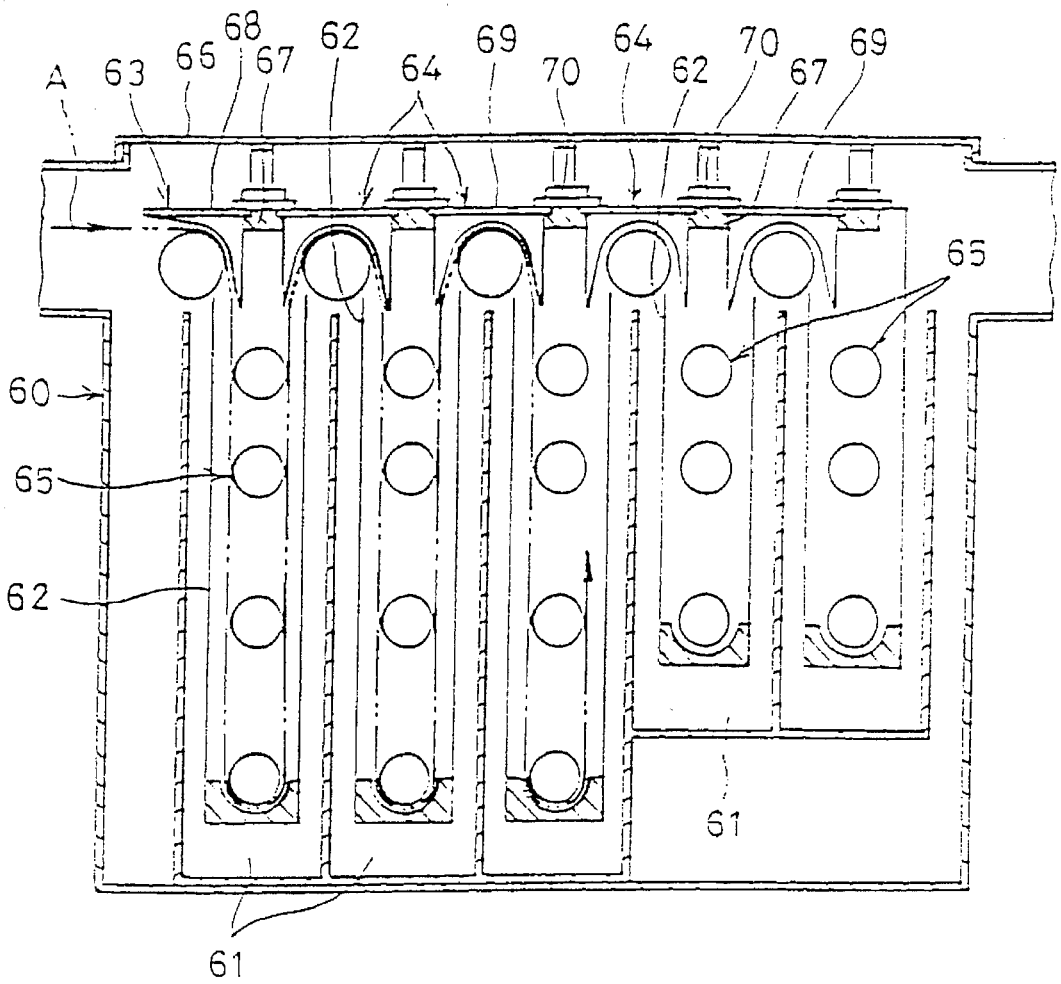
FIG. 8 PRIOR ART
FIG. 8 is a schematic view of a conventional automatic developing machine.
Figure 9:
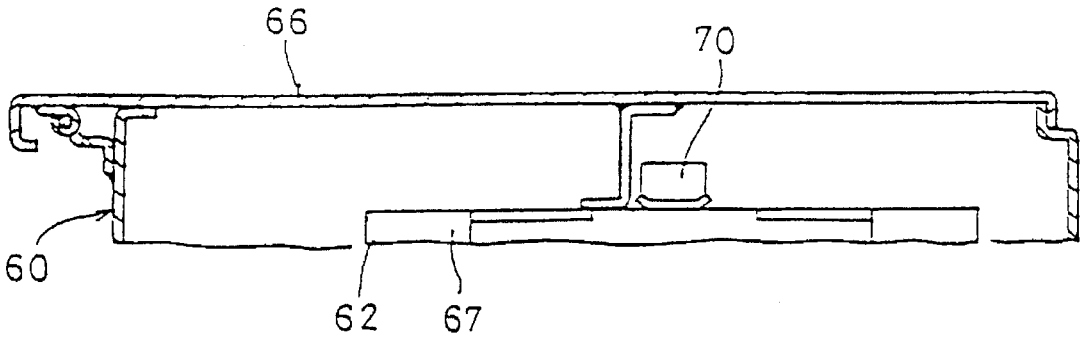
FIG. 9 is a sectional view thereof showing a presser knob of one top turn guide.

The side plates 11 of each rack 10 have top ends protruding upward from the top edges of the front and rear rack plates 13*a*, 13*b*. A handle 21 is provided between the top ends of the side plates 11. As shown in FIGS. 5 and 7, shoulders 22 are formed in the top surface of the handle 21 on the front and rear sides thereof. Also, the handle 21 has recesses 23 in its front and rear surfaces near its top.

Figure 3:
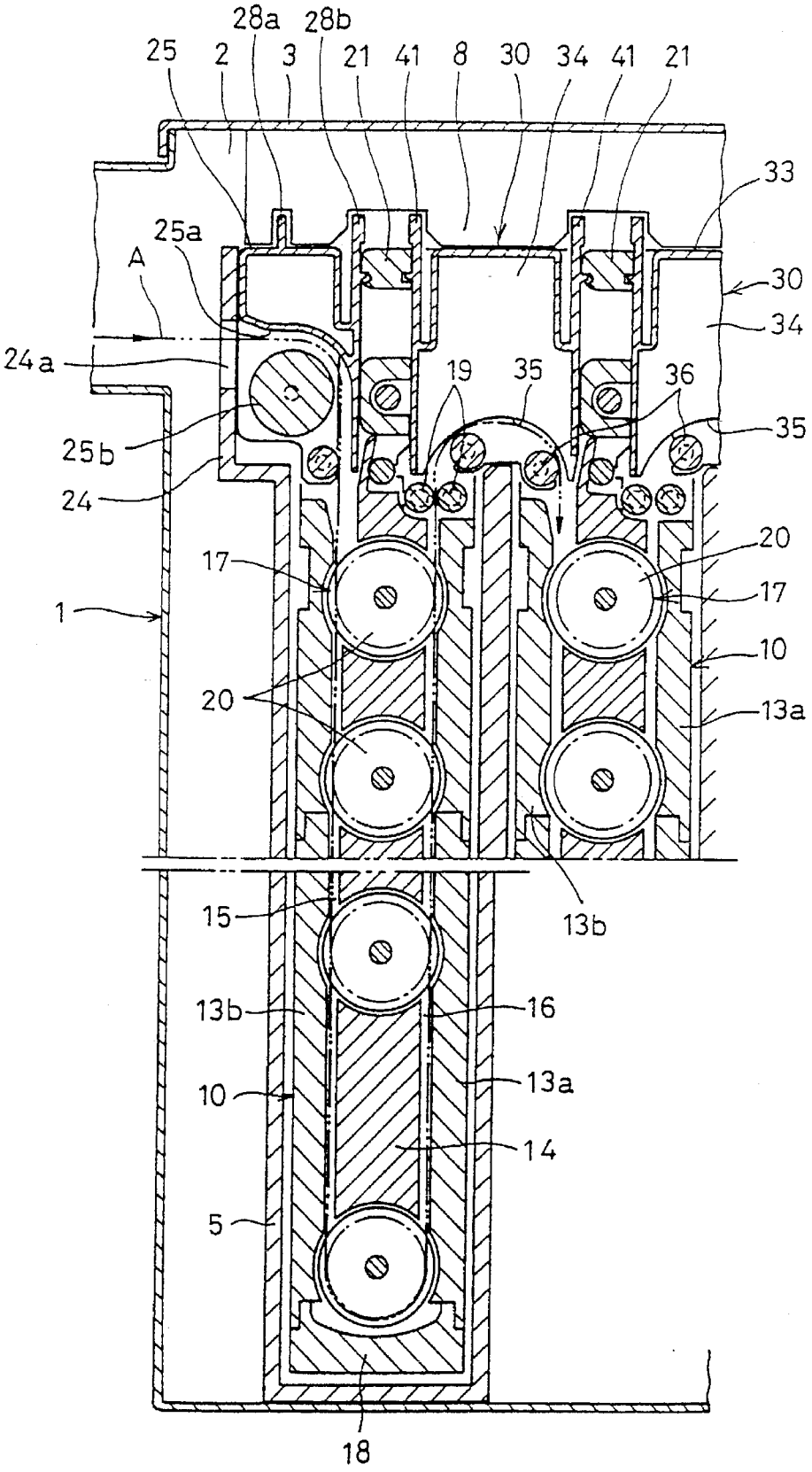
FIG. 3 is a sectional view taken along line III—III of FIG. 2.
Figure 4:
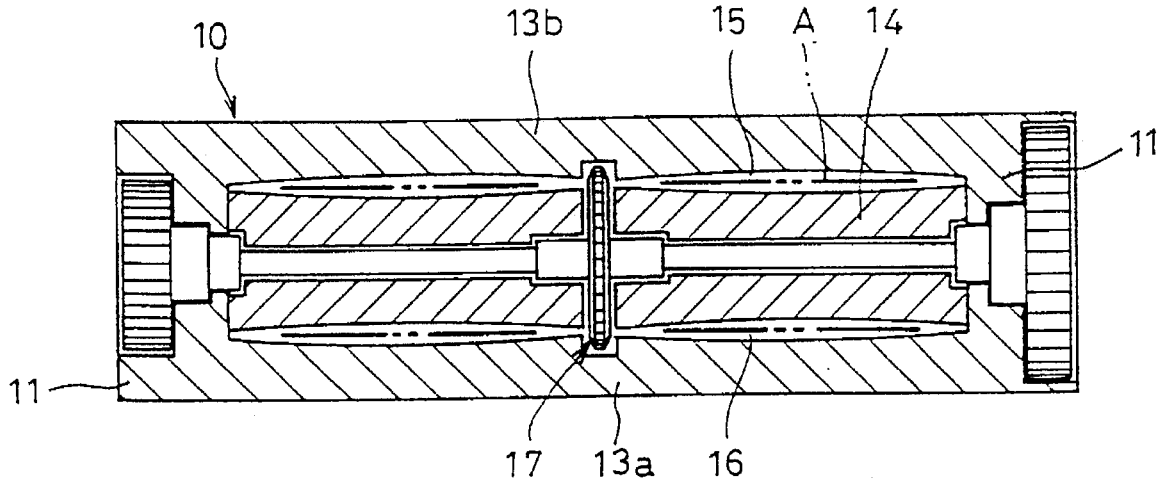
FIG. 4 is a sectional view taken along line IV—IV of FIG. 2.

As shown in FIGS. 1 and 3, an opening 24*a* is formed in the front wall 24 of the treating tank 5 located at the inlet of the developing box 1 for inserting photosensitive material. An inlet guide 25 is disposed between the front wall 24 and the handle 21 of the rack 10 inserted in the treating tank 5 to guide the photosensitive material A that has been fed through the opening 24*a* into the tank.

As shown in FIG. 3, the inlet guide 25 has an arcuate guide surface 25*a* for turning by 90 degrees the photosensitive material A fed through the opening 24*a* into the treating tank 5, and a rotatable guide roller 25*b* having its axis located at the center of curvature of the guide surface 25*a*.

As seen in FIG. 7, the inlet guide 25 has a support flange 26 and protrusions 27 along its top edge. The support flange 26 is supported on the shoulders 22 of the handle 21, while the protrusions 27 are supported on the top edge of the treating tank 5. The inlet guide 25 also has a fixed control piece 28*a* and a resiliently deformable movable control piece 28*b* opposite to the control piece 28*a*.

The movable control piece 28b has a rib 29 adapted to engage in the front recess 23 formed in the handle 21.

When the inlet guide 25 is set in position, where at support flange 26 is supported on the shoulders 22 of the handle 21, and protrusions 27 are supported on the top edge of the treating tank 5, the rib 29 engages the recess 23, locking the inlet guide 25 in position.

As shown in FIG. 1, top turn guides 30 are provided between the adjacent handles 21 of the racks 10 to guide the photosensitive material A being fed upward out of each rack 10 into the immediately adjacent downstream rack 10.

As depicted in FIGS. 5 and 6, each top turn guide 30 comprises a box-shaped member 31 having side plates 32, and a guide frame 33 having side plates 34. Each of the side plates 34 has an arcuate bottom guide edge 35. A plurality of guide rollers 36 provided under the guide edges 35 have both ends thereof rotatably supported by support pieces 37 provided on the outer sides of the side plates 32. The box-shaped member 31 is inserted between the handles 21 of adjacent racks 10. The box-shaped member 31 is provided with support flanges 39 along the top outer edges of its front and rear plates 38. Each top turn guide 30 is set in position by placing the flanges 39 on the shoulders 22 of adjacent handles 21 or on the top surfaces of the handles 21 with the shoulders 22 omitted.

Each plate 38 has two slots 40 extending downward from its top edge. The portion defined between the slots 40 serves as a control piece 41 which can be bent inward. Each control piece 41 has a rib 42. When each top turn guide 30 is set accurately between handles 21, the ribs 42 engage in the recesses 23 formed in the front and rear surfaces of the handles 21.

As shown in FIG. 2, the top cover 3 of the developing box 1 has a pusher 8 for pushing down the inlet guide 25 and the top turn guides 30 to their correct set positions.

To assemble the automatic developing machine of this embodiment, with the racks 10 hung in the treating tanks 5, the inlet guide 25 and the top turn guides 30 are set between the front wall 24 of the treating tank 5 near the inlet and the handle 21 of the rack 10 in this tank, and between the handles 21 of the adjacent racks 10, respectively.

To mount the inlet guide 25, the fixed control piece 28*a* and the movable control piece 28*b* shown in FIG. 7 are gripped from both sides to resiliently deform the movable control piece 28*b*. In this state, the inlet guide 25 is inserted between the front wall 24 and the handle 21. With the support flange 26 supported on the shoulders 22 of the handle 21 and the protrusions 27 supported on the top edge of the treating tank 5, the control pieces 28*a* and 28*b* are released to let the movable control piece 28*b* regain its original shape so that its rib 29 engages in the recess 23. The inlet guide 25 is now locked in position.

To mount each top turn guide 30, the pair of control pieces 41 shown in FIG. 5 are gripped from both sides to resiliently deform them inwardly of the box-shaped member 31. In this state, the turn guide 30 is inserted between adjacent handles 21 until the support flanges 39 are supported on the shoulders 22 of the handles 21. The control pieces 41 are then released.

By releasing the control pieces 41, they are allowed to regain their original shape, so that their ribs 42 will engage in the recesses 23, locking the top turn guide 30 in position.

Figure 6B:
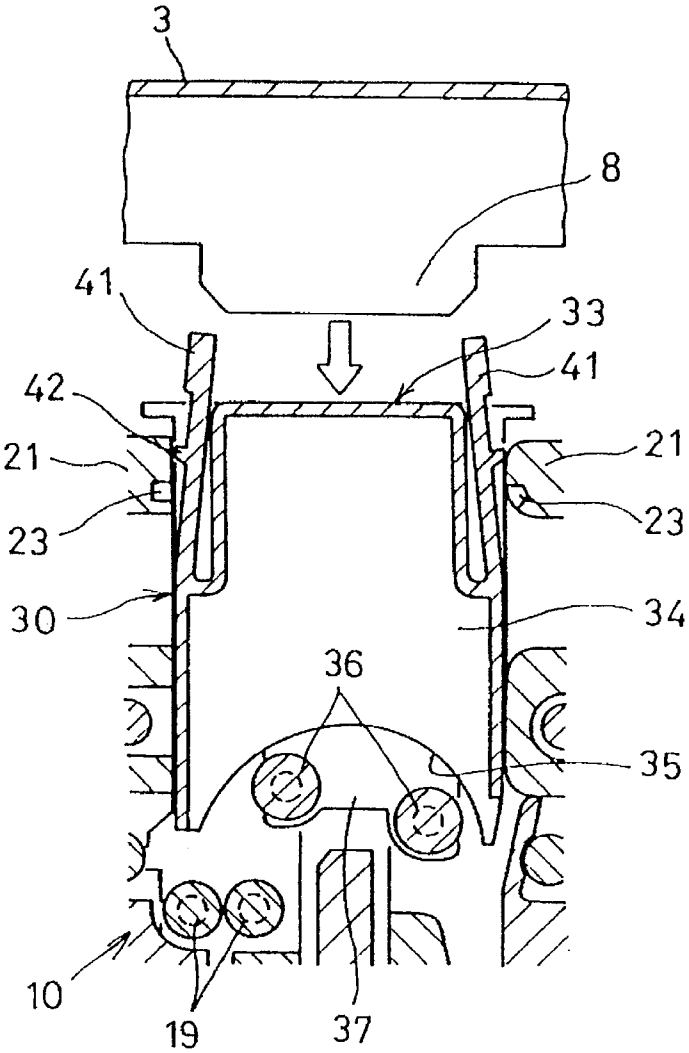
FIG. 6B is a sectional view of the top turn guide showing incompletely set position thereof.
Figure 6A:
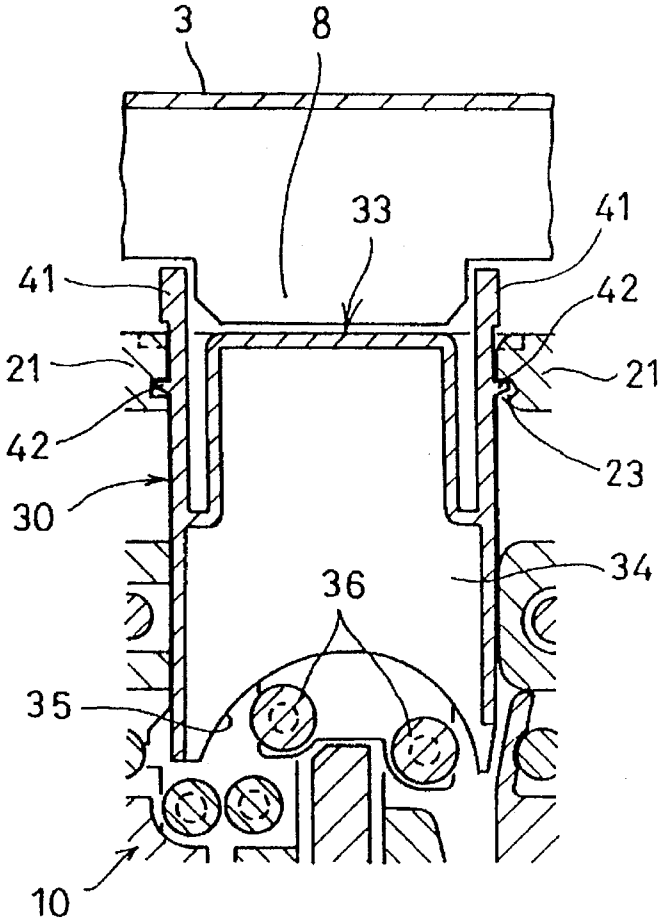
FIG. 6A is a sectional view of the top turn guide showing as incompletely set position thereof.

Even if any top turn guide 30 is not fully inserted as shown in FIG. 6B, so that the support flanges 39 are spaced from the shoulders 22, such top burn guide will be pushed down to the correct set position as shown in FIG. 6A by the pusher 8 of the top cover 3 by closing the top cover 3. In this state, the ribs 42 engage in the recesses 23, locking the top turn guide 30.

In order to ensure that the ribs 42 engage in the recesses 23 by pushing down the top turn guide 30, each rib 42 has its bottom surface tapered.

If the inlet guide 25 is mounted incompletely, it can also be pushed down to its accurate set position by the pusher 8 of the top cover 3 by closing the top cover 3, as with the top turn guide 30. In this state, the rib 29 engages in the recess 23.

To dismount the inlet guide 25 and the top turn guides 30, the top cover 3 is opened, the fixed control pieces 28*a* and the movable control pieces 28*b* and the pair of control pieces 41 are gripped from opposite sides to disengage the ribs 29 and 42 from the recesses 23, and then the guides 25 and 30 are lifted out of the developing box.

In one arrangement, the inlet guide is inserted between the front wall of the treating tank near the inlet and the handle of the rack mounted in this tank, with the movable control piece resiliently deformed by gripping the fixed and movable control pieces from opposite sides. By releasing the control pieces in this state, the protrusion formed on the movable control piece engages in the recess. Thus, the inlet guide can be set in position easily because it is automatically locked simply by setting it in a predetermined position.

In another arrangement, even if the inlet guide is incompletely set, it is pressed down by the pusher to its correct position by closing the top cover. Thus, the inlet guide can be set in position easily and reliably without the need of resetting.

In a further arrangement, each top turn guide is inserted between the handles of the racks with the pair of control pieces resiliently deformed by gripping them from both sides. By releasing the control pieces in this state, the protrusions formed on the control pieces will engage in the recesses. Thus, the top turn guides can be set in position easily because they are automatically locked simply by setting them in a predetermined position.

In a yet further arrangement, even if the top turn guides are incompletely set, they are pressed down by the pusher to correct positions by closing the top cover. Thus, the top turn guides can be set in position easily and reliably without the need of resetting.

What is claimed is:

1. An automatic photographic developing machine comprising:

a developing box, a plurality of treating tanks housed in said developing box, racks mounted in respective said treating tanks and each having a handle for guiding a photosensitive material fed through said treating tanks, and an inlet guide detachably mounted between a front wall of one of said treating tanks that is located at an inlet of said developing box and a handle of the said rack inserted in said one of said treating tanks to guide the photosensitive material fed into said developing box into said rack in said one of said treating tanks, said inlet guide having a support member supported on a top surface of said handle of said rack and having a fixed control piece and a resiliently deformable movable control piece provided opposite to said handle of said rack, said movable control piece being formed with a protrusion adapted to engage in a recess formed in a front surface of said handle.

2. An automatic photographic developing machine as claimed in claim 1, further comprising a top cover for covering an opening formed in a top of said developing box, said top cover being provided with a pusher for pushing down said inlet guide to a position where said support member is supported on said top surface of said handle when said top cover is closed.

3. An automatic photographic developing machine comprising:

a developing box, a plurality of treating tanks housed in said developing box, racks mounted in respective said treating tanks for guiding a photosensitive material fed through said treating tanks, each said rack having a handle at a top thereof, and top turn guides mounted between said handles for guiding a photosensitive material fed upwardly out of each of said racks into a next rack, each of said top turn guides having a support member supported on a top surface of said each handle with said top turn guide set accurately in position, and a pair of resiliently deformable control pieces that oppose respective said handles, each of said control pieces being formed with a protrusion adapted to engage in a recess formed in a front or back surface of said each handle.

4. An automatic photographic developing machine as claimed in claim 3, further comprising a top cover for covering an opening formed in a top of said developing box, said top cover being provided with a pusher for pushing down said top turn guide to a position where said support members are supported on said top surfaces of said handles when said top cover is closed.

* * * * *